United States Patent [19]

Swaim

[11] 4,218,150

[45] Aug. 19, 1980

[54] MATRIX PRINTER

[75] Inventor: Ronald L. Swaim, Sunnyvale, Calif.

[73] Assignee: Vydec, Inc., Florham Park, N.J.

[21] Appl. No.: 962,095

[22] Filed: Nov. 20, 1978

[51] Int. Cl.[3] ..... B41J 3/12

[52] U.S. Cl. ..... 400/124; 101/93.05

[58] Field of Search ..... 400/124, 157.3, 166; 101/93.05

[56] References Cited

U.S. PATENT DOCUMENTS

| | | | |
|---|---|---|---|
| 3,217,640 | 11/1965 | Bradshaw | 400/124 X |
| 3,628,644 | 12/1971 | Cralle et al. | 400/157.3 X |
| 4,022,311 | 5/1977 | Krull | 400/124 X |

*Primary Examiner*—Paul T. Sewell

*Attorney, Agent, or Firm*—Carella, Bain, Gilfillan & Rhodes

[57] ABSTRACT

A moving coil mechanism is utilized to operate each individual print wire of a matrix printing head. Static magnetic fields for the moving coil mechanism may be provided by permanent magnets. Also disclosed is a method for compensating varying frictional forces by sensing the voltage induced in the moving coil and utilizing the information so obtained as an indication of print wire velocity. Current drive to the moving coil can then be modified to maintain print wire velocity substantially independent of varying frictional forces. Also disclosed is an interspersed, or "nested," arrangement of moving coil mechanisms which contributes to the compactness of the improved matrix printer.

5 Claims, 8 Drawing Figures

MATRIX PRINTER

CROSS-REFERENCE TO RELATED APPLICATIONS

To applicant's knowledge, there are no pending applications for United States Letters Patent which relate to the present application.

BACKGROUND OF THE INVENTION

1. Field of the Invention

This invention relates to an improvement in one type of printing apparatus for printing characters on paper and the like. Specifically, the invention is an improved matrix printer.

2. Description of the Prior Art

Matrix printers, as is known to those skilled in the art, form characters by printing a plurality of dots on a printing medium. The dots are printed by impacting the ends of selected print wires against a ribbon and the printing medium. The ends of the print wires are arranged in a substantially 2-dimensional array which is positioned opposite a platen which supports the printing medium. The array is movable laterally along the print line to form selected characters by selective sequential activation of print wires, thereby producing words and other indicia and thereby providing a line of print. The array and the activation components associated with each print wire are located in a unit called the matrix printing head.

Prior art matrix printers activate a selected print wire end by use of a solenoid (generally in conjunction with a pivoting lever arm) which, upon energization, causes the wire to advance longitudinally in its guide toward the platen. In certain prior art systems the solenoid plunger is moved, while in others the plunger is stationary and an associated armature or lever arm is caused to move by attraction to the solenoid plunger. The print wire is pivotably attached to a lever arm in both cases; it is the lever arm being attracted to the plunger, or the plunger attracting or hitting the lever arm, that causes motion of the print wire. In either case, the wire is typically retracted to its normal or rest position by a spring. After repeated use, the movement of the print wires is impeded by increased friction in the guides due to wear, paper dust, etc. The solenoids, generating a fixed magnetic force for a given current input, are unable to overcome this increased friction and therefore cannot maintain proper print wire impact force without an increase in electrical current input to the solenoid coil. Consequently, the print wires move slower and with less impact, thereby causing a deterioration in printing quality. Furthermore, the decreased print wire impact force affects the time and speed of print wire recovery (duty cycle) since the wire is no longer retracted with the same reaction force (i.e. bouncing off the platen) as in a new system, even though a return spring is utilized.

Moreover, to provide proper print wire impact force, relatively large solenoids have been used in prior art matrix printers. Since such printers operate essentially on principles of magnetic attraction, many coils of wire and heavy and massive solenoid plungers were required in such prior art matrix printers. Accordingly, prior art matrix printing heads were relatively massive structures with high inertia, and drive systems for laterally moving the printing head along the print line necessarily had to be larger, stronger, and naturally more costly. Massive printing heads of solenoid type matrix printers also limited printing speed by inhibiting lateral movement along the print line. Furthermore, prior art solenoid type matrix printers utilizing moving plungers also must overcome the inertial mass and consequently low acceleration characteristics of the plunger, thus further limiting maximum available printing speed. Also, to improve efficiency and increase mechanical advantage, solenoids are generally used with pivoted lever arms to provide a compromise between overall matrix printing head size and weight and the impact force that may be generated for a given electrical power input. The resulting prior art arrangement unfortunately still has an undesirably large size and weight and undesirable mechanical complexity.

Furthermore, solenoids require a relatively large amount of current to generate a suitable print wire impact force. That is, as is well-known to those skilled in the art, the magnetic field induced by the solenoid coil in the solenoid plunger must be of sufficient magnitude to rapidly attract a lever arm to the plunger (or vice versa). The magnitude of the field determines the rapidity of movement of the print wire and consequently determines the impact force of the print wire on the printing medium. A relatively large current is needed to produce the desired magnetic field, and this mandates relatively large, heavy and costly electrical power supplies and other components.

Another inherent deficiency of prior art solenoid type matrix printers is their limitation of printing speed due to temperature effects. Solenoid characteristics restrict the speed with which magnetic flux may be built up to a sufficient magnitude to produce acceptable print wire impact forces. As is well-known to those skilled in the art, there is a tradeoff between speed and solenoid temperature rise since the faster a solenoid is cycled on and off, i.e. the faster the printing speed, the greater the temperature rise within the solenoid.

Additionally, prior art matrix printers generally have the activating solenoids arranged radially about a central axis. Generally, a plurality of solenoids are arranged in a plane and the diameter of the essentially cylindrical structure thus formed is relatively large, depending upon several parameters, one of which is the number of print wires desired in the matrix printer. The size of this matrix printing head restricts visibility of the printed characters. While this matrix printing head size does not render such a printer objectionable as a computer printer, it does render the matrix printer unsuitable as a consumer-oriented product such as a typewriter.

It is apparent that the aforementioned unavoidable inherent deficiencies of solenoid type matrix printers generally necessitate larger, stronger and costlier ancillary elements such as larger power supplies and other components necessary for lateral movement of the carriage holding the matrix printing head.

Accordingly, there is a need in the matrix printer art for a matrix printing head capable of rapidly printing characters with an acceptable print wire impact force while being simultaneously efficient and lightweight in order to simplify the supply of power to the matrix printing head, particularly, for a larger number of print wires, e.g., more than 14 wires.

While a prior printing apparatus has been discovered utilizing an operating principle similar to the present invention, that prior art printer, as disclosed in U.S. Pat. No. 3,087,421, issued Apr. 30, 1963 and entitled "High Speed Printer" was not a matrix printer. In any event, the disclosed printing apparatus did not employ print wires and did not utilize several elements of the subject invention, as will be more clearly understood below.

SUMMARY OF THE INVENTION

The present invention solves the aforementioned prior art problems by providing a retraction matrix printing apparatus wherein both advancement and retraction of print wires are accomplished by the forces arising from interaction of current-carrying conductors with magnetic fields.

This invention is more efficient than prior art solenoid type matrix printers and requires less power, size and weight to produce the same magnitude impact forces as solenoid systems. The invention also enables the construction of matrix printers having printing speeds greater than those of prior art printers. Additionally, the decreased weight of the matrix printing heads constructed in accordance with this invention simplifies associated printer elements required for lateral movement of the printing head along the print line.

Furthermore, the interspersal of adjacent activation components enables construction of a small matrix printing head for consumer-oriented printers where visibility of characters is desirable.

Accordingly, it is an object of this invention to provide a more efficient activation component for advancing and retracting a print wire.

Another object of this invention is to produce a highly efficient matrix printing head capable of generating high impact forces with fewer and less massive components than are required in prior art systems.

Another object of this invention is to produce a matrix printing head of a size suitable for use in conventional typewriters, as distinguished from computer terminals and line printers.

BRIEF DESCRIPTION OF THE DRAWINGS

The invention will be better understood by reference to the following drawings.

DESCRIPTION OF THE INVENTION

Figure 1:
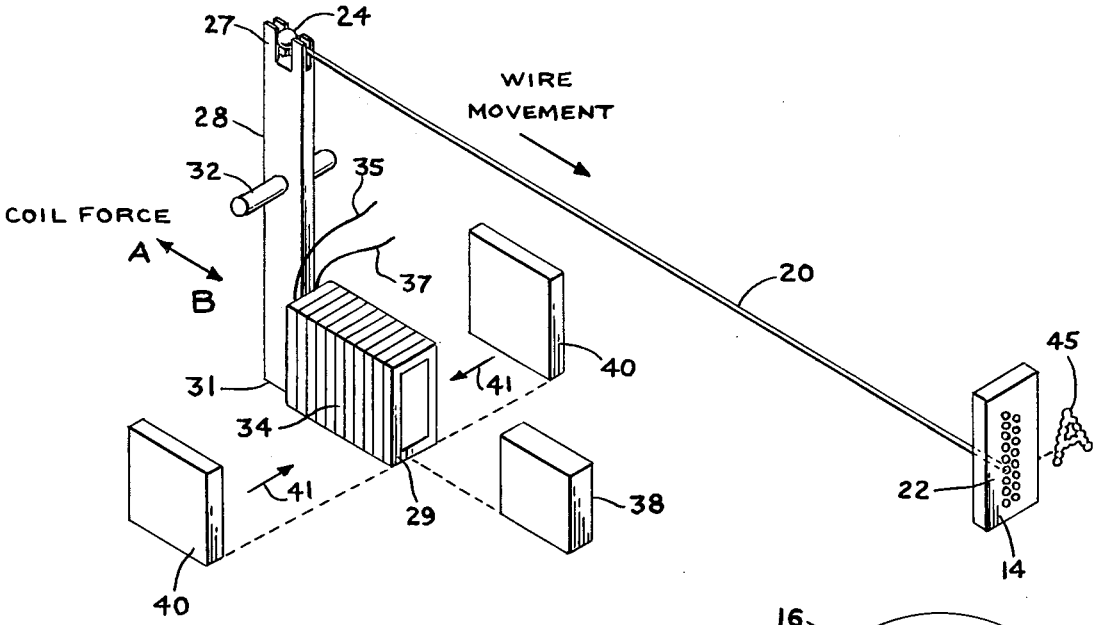
FIG. 1 is an exploded isometric view of the activation components of the preferred embodiment.

The present invention may be understood by reference to FIG. 1, which illustrates the principles of operation of the preferred embodiment.

In FIG. 1 there is shown a print wire 20 having a front end 22. For the sake of clarity, only one print wire is shown in FIG. 1 although it is noted that all other print wires are similarly activated and that the front ends 22 of the plurality of print wires 20 form a substantially two-dimensional array designated as matrix 14.

The rear end 24 of print wire 20 is pivotably attached to the central end 27 of an arm 28 pivoted about pivot shaft 32. The peripheral end 31 of arm 28 has affixed thereto an electrically nonconductive cylindrical coil support 29 about which is wound a coil 34 of electrically conductive material. Adjacent opposite sides of coil support 29 are two permanent magnets 40 having their magnetic fields 41 symmetrically oriented relative to coil support 29. Although the coil support and permanent magnets shown in FIG. 1 are generally rectilinear, it will be recognized by those skilled in the art that curvilinear components may also be utilized.

It will also be understood that current may be passed through coil 34 by means of leads 35 and 37, and the current in coil 34 will establish a magnetic field about coil 34. The interaction of this electromagnetic field with the magnetic fields 41 of permanent magnets 40 will urge peripheral end 31 of arm 28 to move in direction A or B depending upon direction of the current.

The activation of print wires in a matrix printer constructed in accordance with this invention is accomplished with greater efficiency than in prior art solenoid type matrix printers. First of all, it is obvious that solenoid plungers are not utilized and the wieght of a matrix printing head constructed in accordance with this invention is thus considerably less than prior art matrix printing heads. Secondly, a second magnetic field established by the coil of prior art solenoid printers had to operate upon associated passive ferro-magnetic components. For example, the solenoid coil attracted a ferromagnetic armature. However, in the preferred embodiment the impact forces are established by the interaction of an electric current with a magnetic field established by permanent magnets. It will be understood by those skilled in the art that for a given current input such interaction of an electric current with a magnetic field established by permanent magnets produces a net force greater than the interaction of a single active magnetic field with a passive ferromagnetic component.

Enhancement of the interaction forces between the permanent and electromagnetic magnetic fields is achieved by use of center pole 38 which may be a ferromagnetic material shaped for matable engagement with the central cylindrical portion of coil support 29. Center pole 38 should be as large as possible relative to the aperture of coil support 29 while not hampering relative motion between center pole 38 and coil support 29. Coil support 29 should be constructed of a relatively thin non-magnetic material, such as plastic, which is essentially transparent to lines of magnetic flux emanating from permanent magnets 40, so that magnetic flux will find a low reluctance path through coil 34, coil support 29 and into center pole 38 and back to permanent magnets 40 through an interconnecting low reluctance backing plate (not shown) to which center pole 38 and permanent magnets 40 are affixed. As will be known by those skilled in the art, the number of flux linkages between the permanent magnets 40 and coil 34 will be increased by use of center pole 38, and the force causing motion of peripheral end 31 of arm 28 along line A–B will be greater for a given electrical current in coil 34 than if center pole 38 were not present. The various magnets, coils and center poles may be conveniently referred to as activation components.

Figure 7:
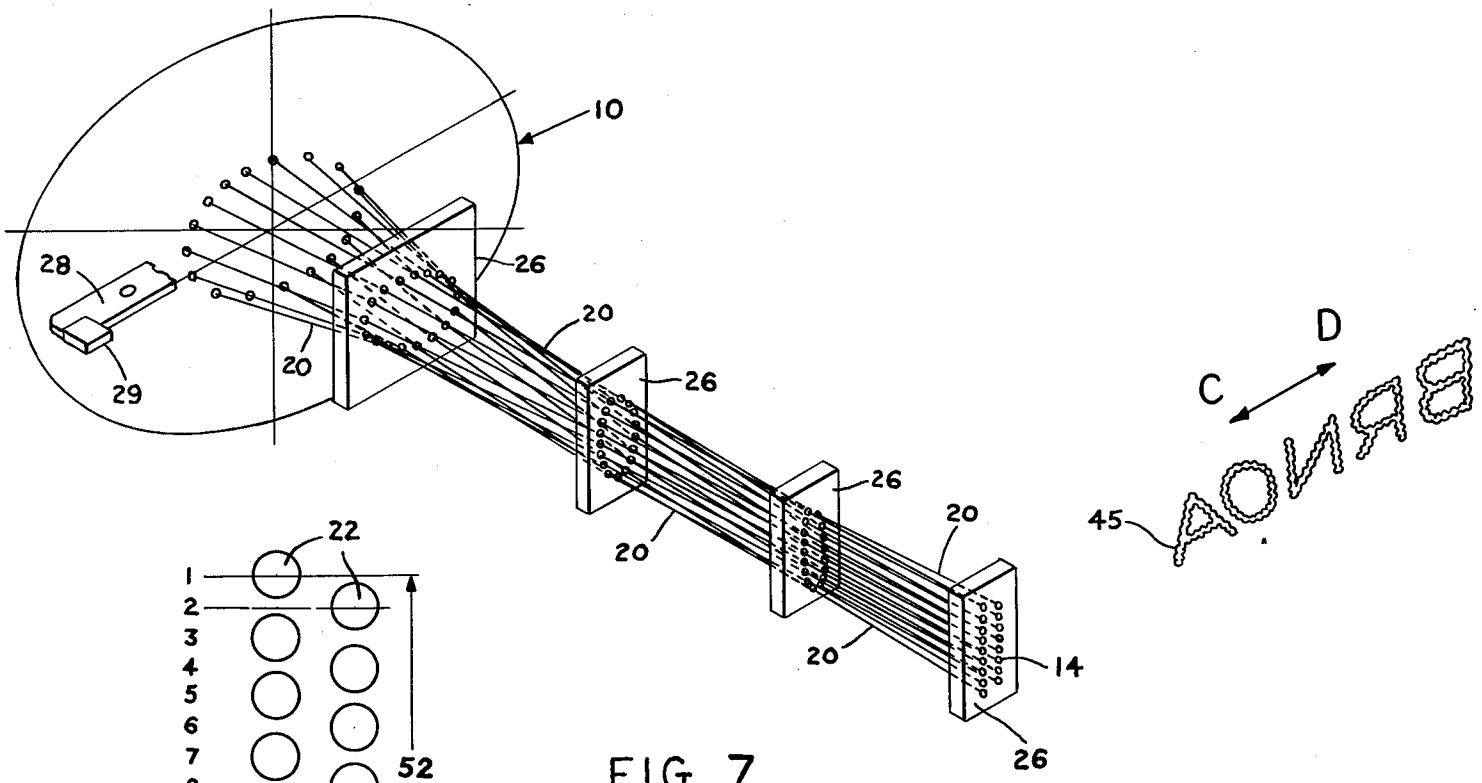
FIG. 7 is an isometric view showing the arrangement of components of the matrix printing head.

As peripheral end 31 of arm 28 is moved along line A–B in the direction of A, print wire 20 is caused to advance toward and impact a ribbon (not shown) in FIG. 1. As peripheral end 31 of arm 28 is moved along line A–B in the direction of B, print wire 20 is caused to retract from the ribbon. Identical arms 28 and associated activation components are utilized to activate all other print wires 20 having front ends 22 in matrix 14. Selective activation of individual coils 34 (and therefore individual print wires 20) causes matrix printing head 10 (shown in FIG. 4) to print a series of dots as it moves along a print line. The dots form characters 45 as shown in FIGS. 1 and 7. The several arms 28 are arranged substantially radially about a printing head axis 19, as shown in FIG. 4, which axis is substantially parallel to print wires 20.

Figure 2:
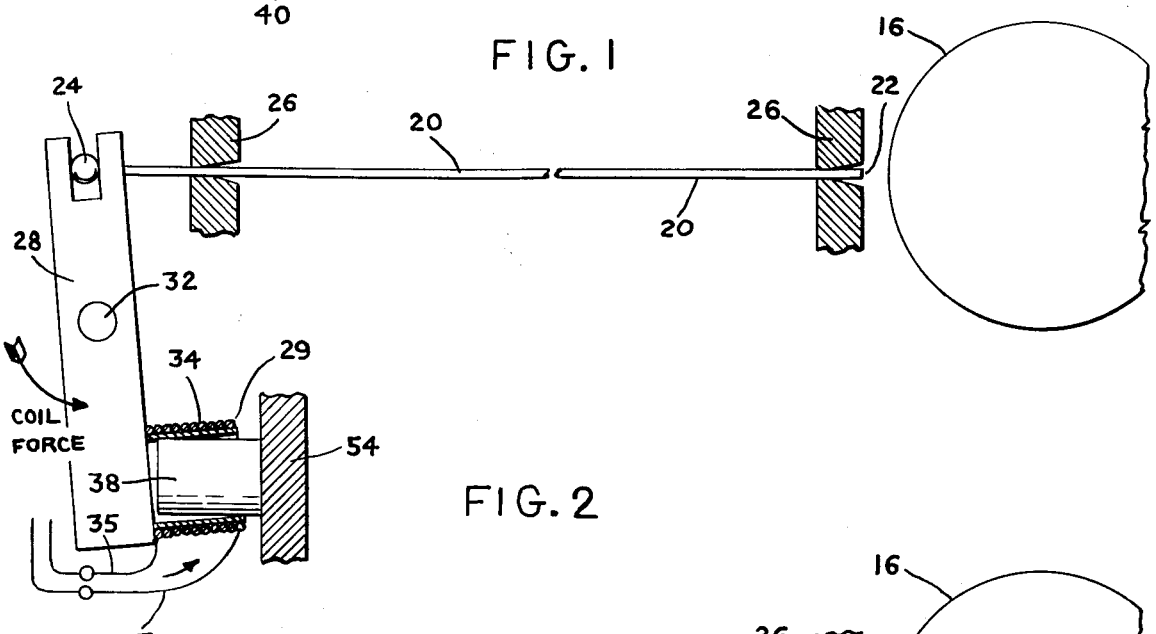
FIG. 2 is a side view of the preferred embodiment with the print wire in a retracted position.
Figure 3:
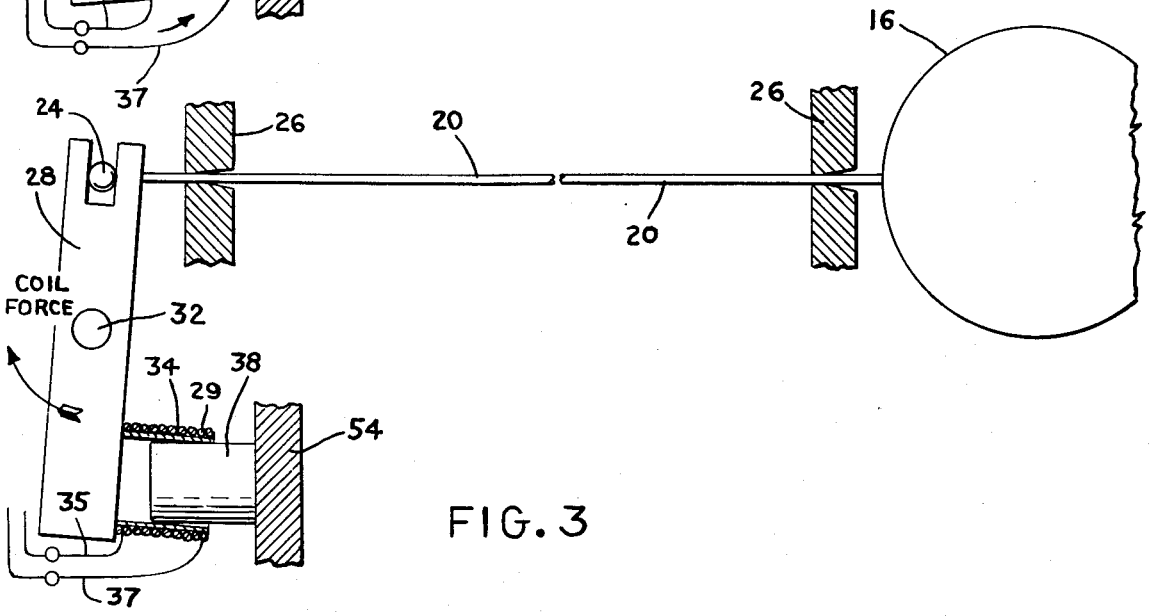
FIG. 3 is a side elevational view of the preferred embodiment with the print wire in an extended position.

Referring now to FIG. 2, there is shown a side view of the arms 28 and print wire 20 shown in FIG. 1. Also shown is apertured guide plate 26, through which print wire 20 passes immediately in front of platen 16. For clarity, coil support 29 is depicted in sectional view to show the relationship between center pole 38 and coil support 29. FIG. 2 shows print wire 20 in a retracted or rest position relative to platen 16. In this position no current (or a reverse current) is flowing through leads 35 and 37. Upon passage of current in one direction through leads 35 and 37 a magnetic field will be established around coil 34 which will interact with the magnetic fields 41 of permanent magnets 40 to cause arm 28 to pivot about pivot shaft 32, thereby causing front end 22 of print wire 20 to impact on platen 16 as shown in FIG. 3. As is well-known to those skilled in the art, the intensity and direction of the magnetic field of coil 34 is a function of the magnitude and direction of the electrical current in coil 34. Thus, print wire 20 may be advanced or retracted at different velocities depending upon the magnitude and direction of electrical current in coil 34.

If friction increases in the matrix printing head 10 due to wear, paper dust, etc., the magnetic force acting on coil 34 may be increased to compensate for the friction (which tends to decrease the velocity of print wire 20). The effect of friction may be constantly determined by monitoring the voltage waveform across coil 34. As is well-known to those skilled in the art, motion of coil 34 relative to magnets 40 generates a back electromotive force which, if monitored by some voltage sensing means provides information on the velocity of coil 34 and hence the velocity of print wire 20. This feedback enables a compensatory increase in coil current to maintain proper print wire impact force.

Figure 4:
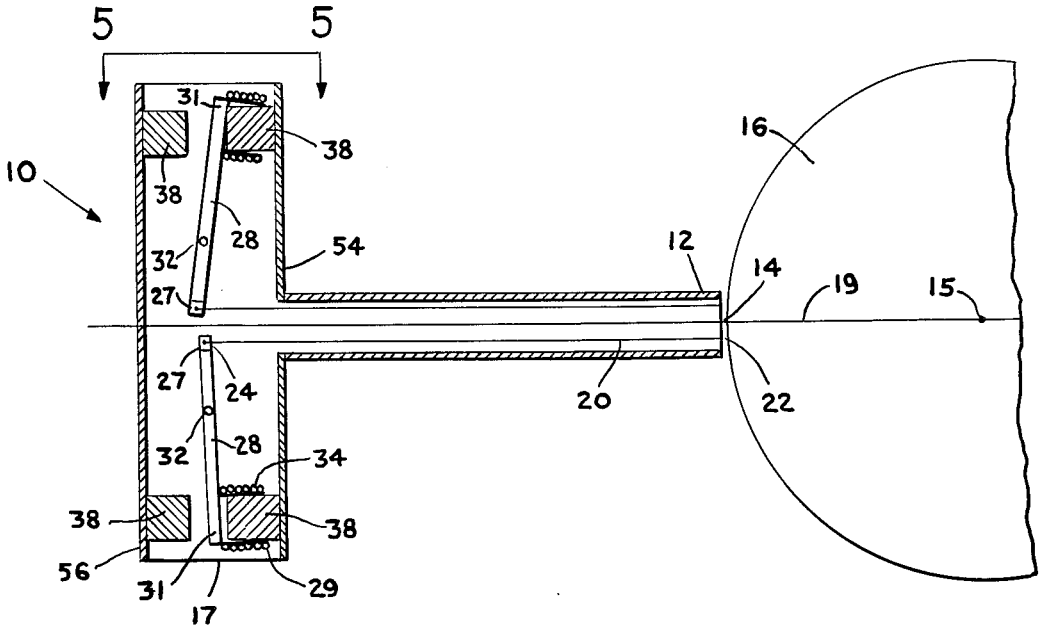
FIG. 4 is a side view of a matrix printing head showing the arrangement of some activation components of the preferred embodiment.

Referring now to FIG. 4, there is shown a side view of a matrix printing head generally designated as 10. FIG. 4 schematically shows the placement of arms 28 in the base portion 17 of matrix printing head 10 although, for the sake of clarity, permanent magnets 40 are not shown. Matrix printing head 10 is generally mounted on a carriage (not shown) which is movable laterally along a print line relative to platen 16.

The matrix printing head 10 has a front end 12 within which are contained front ends 22 of, for example, seventeen print wires 20. When at rest, front ends 22 of print wires 20 form an array designated as matrix 14 which lies in a plane tangent to platen 16. If desired, matrix 14 may naturally be made to form an arcuate surface conforming to the surface of platen 16.

Each of the seventeen print wires utilized in the preferred embodiment has associated therewith, as previously described in connection with FIG. 1, an arm 28, coil 34, permanent magnets 40 and center pole 38. Since each print wire 20 is approximately perpendicular to its respective arm 28, the seventeen arms are conveniently arranged radially about printing head axis 19 in base portion 17 of matrix printing head 10.

The invention herein permits construction of a matrix printing head 10 having a relatively small base portion 17. The seventeen arms 28 and their respective activation components are alternately mounted in base portion 17. Such interspersed, or "nested," construction enables base portion 17 to be smaller in diameter than if the seventeen arms were not interspersed.

Figure 5:
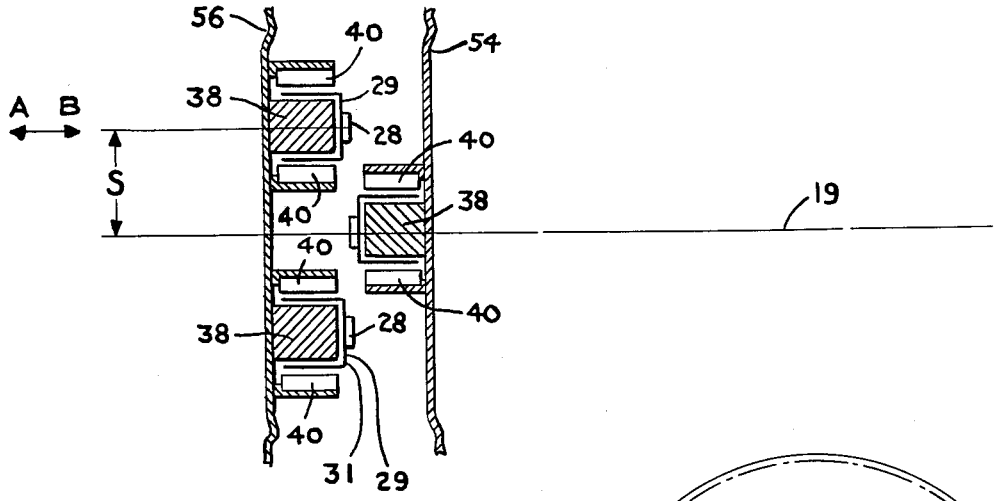
FIG. 5 is an edge view of a portion of the matrix printing head shown in FIG. 4, looking along line A—A.
Figure 6:
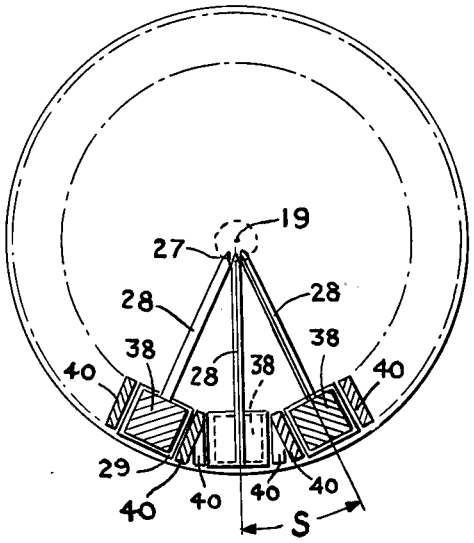
FIG. 6 is a left side view of the matrix printing head of FIG. 4.

The interspersal of arms 28 is best understood by reference to FIGS. 4, 5 and 6. It will be noted by reference to FIG. 4 that each of the center poles 38 is secured to, or made an integral part of, either the front, 54, or rear, 56, plates of base portion 17. With seventeen print wires utilized in the preferred embodiment, obviously an even division is not possible so the front plate 54 is arbitrarily selected to carry (have affixed thereto) nine center poles 38 while the rear plate 56 carries eight. The division of seventeen center poles 38 between front and rear plates enables use of shorter arms 28 because only nine, rather than seventeen, sets of activation components are mounted along the circumference of base portion 17.

For clarity, only two arms 28 associated with front plate 54 are shown in FIG. 4, although it will be understood that similar arms are associated with rear plate 56. Furthermore, it should be understood that FIG. 4, while a cross-sectional view, is not necessarily a diametric cross-section. FIG. 4 should not be read to imply that the center poles 38 (shown at top and bottom of FIG. 4) are necessarily spaced 180° about printing head axis 19, which would imply an even number of center poles associated with both front plate 54 and rear plate 56 of base portion 17. The preferred embodiment has an odd number (nine) of center poles associated with the front plate 54, and FIG. 4 is intended merely to schematically depict the arrangement of arms 28 in matrix printing head 10.

The division of center poles 38 between front plate 54 and rear plate 56 does not of itself accomplish the aforementioned interspersal. The interspersed arrangement of arms 28 is best understood by reference to FIG. 5 which is a top view of the base portion 17 shown in FIG. 4. Thus, FIG. 5 is a view along a radius perpendicular to printing head axis 19. While FIG. 5 is shown as a linear schematic, it will be understood that it is an edge view of a curved structure. It is also noted that the coil 34 associated with each arm 28 and print wire 20 is not shown on FIGS. 5 and 6.

FIG. 5 is illustrative of the interspersal principle of this invention. It will be noted that the peripheral ends 31 of arms 28 are shown in FIG. 5 as being adjacent center poles 38 associated with front plate 54 and rear plate 56. As explained above, interaction of the magnetic fields of permanent magnets 40 and coils 34 (not shown) will cause peripheral ends 31 of arms 28 to move along the line A–B which is substantially parallel to printing head axis 19. As shown in FIG. 5, the center poles 38 affixed to front plate 54 are not aligned with the center poles 38 affixed to rear plate 56. Although the center poles affixed to each plate are radially arranged on that particular plate, the center poles affixed to front plate 54 are angularly displaced from the center poles affixed to rear plate 56. That is, the center poles on front plate 54 are angularly displaced from the center poles on rear plate 56 by an angle S. Angle S is more clearly seen in FIG. 6 which is a left side view of the matrix printing head 10 of FIG. 4.

The angular displacement of center poles 38 and, consequently, the angular displacement of activation components associated therewith, enables the peripheral end 31 of each arm 28, upon pivoting, to extend partially into the space between center poles 38 on the opposite plate.

FIG. 7 shows an isometric view of part of the matrix printing head 10 to clarify the arrangement of print wires 20 and arms 28. Also shown are apertured guide plates 26. For clarity, only one arm 28 is shown. As matrix printing head 10 is moved along direction C–D laterally along a print line, selective activation of wires causes characters 45 to be printed (platen, printing medium and ribbon are not shown).

Figure 8:
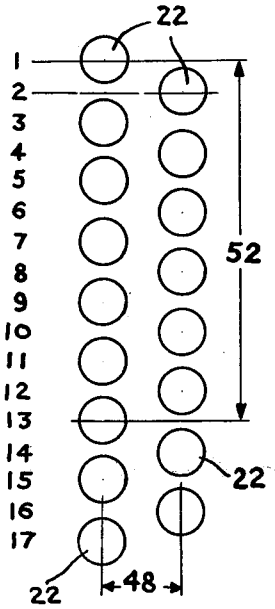
FIG. 8 is a front elevational schematic view of the arrangement of print wire ends in a matrix array.

FIG. 8 shows the arrangement of the seventeen print wire ends 22 in matrix 14. While horizontal spacing 48 is not critical, vertical spacing 50 must be such that adjacent printed dots will overlap sufficiently to print esthetically pleasing characters suitable for business letters, etc. Character height will generally be within distance 52 defined by the top thirteen wire ends, although underscoring and other characters may be printed by the lower four wire ends.

The efficiency of this invention and its ability to generate high impact forces is naturally enhanced by decreasing inertia by use of lighweight material such as aluminum or plastic. The efficiency also enables the use of arms 28 shorter than the levers of prior art solenoid systems, since suitable impact forces may be generated without the need for as large a mechanical advantage as is required in prior art systems. Use of shorter arms 28 tends to decrease the diameter of base portion 17; further reduction is achieved by the aforementioned interspersal arrangement.

It will be apparent to those skilled in the art that numerous modifications and embodiments of this invention may be made without departing from the spirit and the scope thereof.

What is claimed is:

1. An apparatus for printing indicia comprising:

a. print wire means having a front end and a rear end, the print wire means for printing indicia upon a printing medium by impact of the front end of the print wire means upon a ribbon positioned between the front end of the print wire means and the printing medium;

b. pivoting arm means having a central end, a pivot, and a peripheral end, the central end of the pivoting arm means secured to the rear end of the print wire means, the pivoting arm means for producing translational motion of the print wire means;

c. cylindrical coil means, secured to the peripheral end of the pivoting arm means, the cylindrical coil means for applying an electromagnetic force to the peripheral end of the pivoting arm means, thereby to produce rotational motion, about the pivot, of the pivoting arm means and thus translational motion of the print wire means, the electromagnetic force applied by the cylindrical coil means to the peripheral end of the pivoting arm means related to electrical current in the cylindrical coil means and also related to an external magnetic field applied to the cylindrical coil means;

d. means for applying the external magnetic field to the cylindrical coil means;

e. whereby application of a first electrical current to the cylindrical coil means results in a first electromagnetic force applied to the pivoting arm means, causing the pivoting arm means to rotate about the pivot so as to cause translational motion of the print wire means in a first direction, causing the front end of the print wire means to impact upon the ribbon, thereby to print an indicium upon the printing medium; and, f. whereby application of a second electrical current, opposite in direction to the first electrical current, to the cylindrical coil means results in translational motion of the print wire means in a second direction, opposite to the first direction, thereby causing the front end of the print wire means to retract from the ribbon.

2. An improved matrix printing head of the type having a plurality of means for printing indicia, each means for printing indicia including:

a. print wire means having a front end and a rear end, the print wire means for printing indicia upon a printing medium by impact of the front end of the print wire means upon a ribbon positioned between the front end of the print wire means and the printing medium;

b. pivoting arm means having a central end, a pivot, and a peripheral end, the central end of the pivoting arm means secured to the rear end of the print wire means, the pivoting arm means for producing translational motion of the print wire means;

c. activation means, secured to the peripheral end of the pivoting arm means, the activation means for producing rotational motion, about the pivot, of the pivoting arm means and thus translational motion of the print wire means;

d. wherein the individual activation means of the plurality of means for printing indicia constitute a plurality of activation means; wherein the improvement comprises:

e. the plurality of activation means comprising a first group of activation means and a second group of activation means;

f. wherein the first group of activation means are secured to a mounting structure in a first substantially circular arrangement in a first plane, with substantially equal angular separation between each individual activation means of the first group of activation means; and, g. wherein the second group of activation means are secured to the mounting structure in a second substantially circular arrangement in a second plane, with each individual activation means of the second group of activation means interspersed between adjacent activation means of the first group of activation means.

3. An improved matrix printing head as recited in claim 2, wherein the first group of activation means is equal in number to the second group of activation means.

4. An improved matrix printing head as recited in claim 2, wherein the first group of activation means differs in number by one from the second group of activation means.

5. An improved matrix printing head as recited in claim 2, wherein the second plane containing the second group of activation means is substantially parallel to, and displaced from, the first plane containing the first group of activation means.

* * * * *